United States Patent [19]

Dunham

[11] Patent Number: 5,006,678

[45] Date of Patent: Apr. 9, 1991

[54] PRESSURE SWITCH WITH DEADBAND ADJUSTMENT

[75] Inventor: Lawrence A. Dunham, Northridge, Calif.

[73] Assignee: ITT Corporation, New York, N.Y.

[21] Appl. No.: 425,773

[22] Filed: Oct. 23, 1989

[51] Int. Cl.[5] ..... H01H 35/40

[52] U.S. Cl. ..... 200/83 S; 200/83 R

[58] Field of Search ..... 200/83 S

[56] References Cited

U.S. PATENT DOCUMENTS 3,772,490 10/1973 Thordarson ..... 200/83 S

*Primary Examiner*—Robert S. Macon

*Attorney, Agent, or Firm*—Menotti J. Lombardi

[57] ABSTRACT

A wire wand is inserted into a pressure sensor perpendicular to the sensor's operating axis. The wire wand is fixed and adjustable at one end and driven at the other end by the sensor. The arrangement provides for deadband adjustment of a pressure switch.

20 Claims, 2 Drawing Sheets

PRESSURE SWITCH WITH DEADBAND ADJUSTMENT

BACKGROUND OF THE INVENTION

This invention relates to deadband adjustment and more particularly to pressure switches with deadband adjustment.

A snap action device employing a belleville spring with adjustments operable to increase or decrease the resistance of the belleville spring to provide a snap action response at a predetermined force is known from U.S. Pat. No. 3,030,096.

In prior U.S. Pat. No. 3,876,845, in which I am a co-inventor, there is described the theoretical analysis of certain spring rate and load considerations. The deadband is defined as the difference between actuating and reset pressures, i.e., increasing and decreasing pressure settings.

As is known from the prior art, pressure switches require adjustability of the difference between operating pressure and reset pressure (deadband). A number of the known devices incorporate adjustment of the electrical switch operating characteristics, the pressure sensor movement, or by introduction of a step change in spring rate somewhere within the operating movement. The later only working with positive rate devices. However, all prior art devices do not adequately function in combination with snap action devices, such as the belleville spring devices referenced above. Further, most prior art adjustments can lead to failure of the pressure switch due to the switch element being adjustable to a zero contact gap or the sensor motion being adjustable to zero.

Accordingly, the problem of deadband adjustment of pressure switches is solved by the invention.

SUMMARY OF THE INVENTION

An object of the invention is to provide an improved deadband adjustment arrangement.

Another object of the invention is to provide an arrangement having a continuously adjustable positive spring rate which is equally compatibIe with positive rate (trace) devices and negative rate (snap action) devices.

A further object of the invention is to provide a device having an adjustment which does not affect the important operating characteristics of the mechanism, in that the adjustment does not adjust the switch element contact gap or the sensor movement.

According to the broader aspects of the invention, a wire wand is inserted into a pressure sensor perpendicular to the sensor's operating axis, and the wire wand is fixed at one end and driven at the other end by the sensor.

A feature of the invention is to provide deadband adjustment in a pressure switch by means of the wire wand.

BRIEF DESCRIPTION OF THE DRAWINGS

The above and other objects, features and advantages of the present invention will become more fully apparent from the following detailed description of the preferred embodiments, the appended claims and the accompanying drawings in which:

DETAILED DESCRIPTION THE PREFERRED EMBODIMENTS

Figure 1:
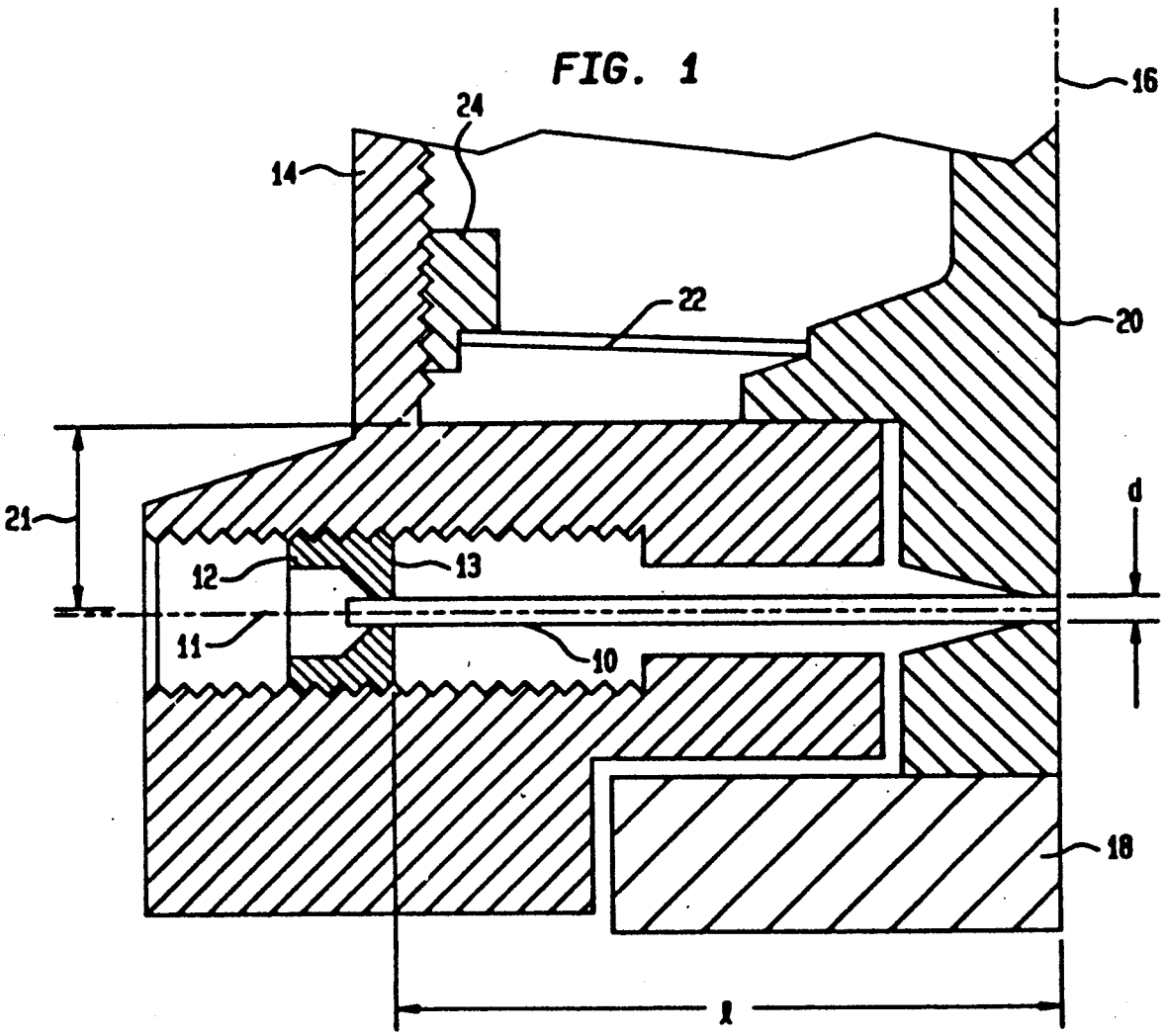
FIG. 1 illustrates the wire wand deadband adjustment according to the invention.

Referring now to FIG. 1, a wire wand 10 is fixed at one end by means of a set screw 12 which is adjustable in housing 14 in a direction perpendicular to the operating axis 16 of a pressure sensor including a pressure plate 18 and a biased actuator 20. Actuator 20 may be biased by a belleville spring 22 which is retained in housing 14 by belleville retainer 24. Preferably, wand 10 is fabricated from 302SST, spring tempered wire, and silver brazed into a weldable SST set screw 12. During welding, a heat sink should be attached to the wire to avoid annealing beyond, for example, 0.125 inches from face 13 of screw 12. The center line 11 of wire wand 10 should be slightly offset, from the hole center line distance 21 of actuator 20 to provide the desired preload on wand 10.

As shown, the wire wand 10 is fixed at one end in a threaded part and driven at the other end by the actuator part of the sensor. The effective length (1) of the wand is adjusted by rotating the threaded part toward (or away from) the operating axis 16 of the sensor. Since this adjustment varies the effective length (1) of the wand, and the spring rate of the wand is a function of (1), the adjustment provides a wide range of possible spring rates.

Theoretically, for a round wire section cantilever, the spring rate (R) is determined by the formula:

$$R = \frac{3EI}{l^3}$$

where:

l = effective length

E = material elasticity $$I = \frac{\pi}{4}\left(\frac{d}{2}\right)^4$$

where:

d = wire diameter

Accordingly, the desired spring rates and changes of spring rate may be determined for different wires and effective length.

Figure 2:
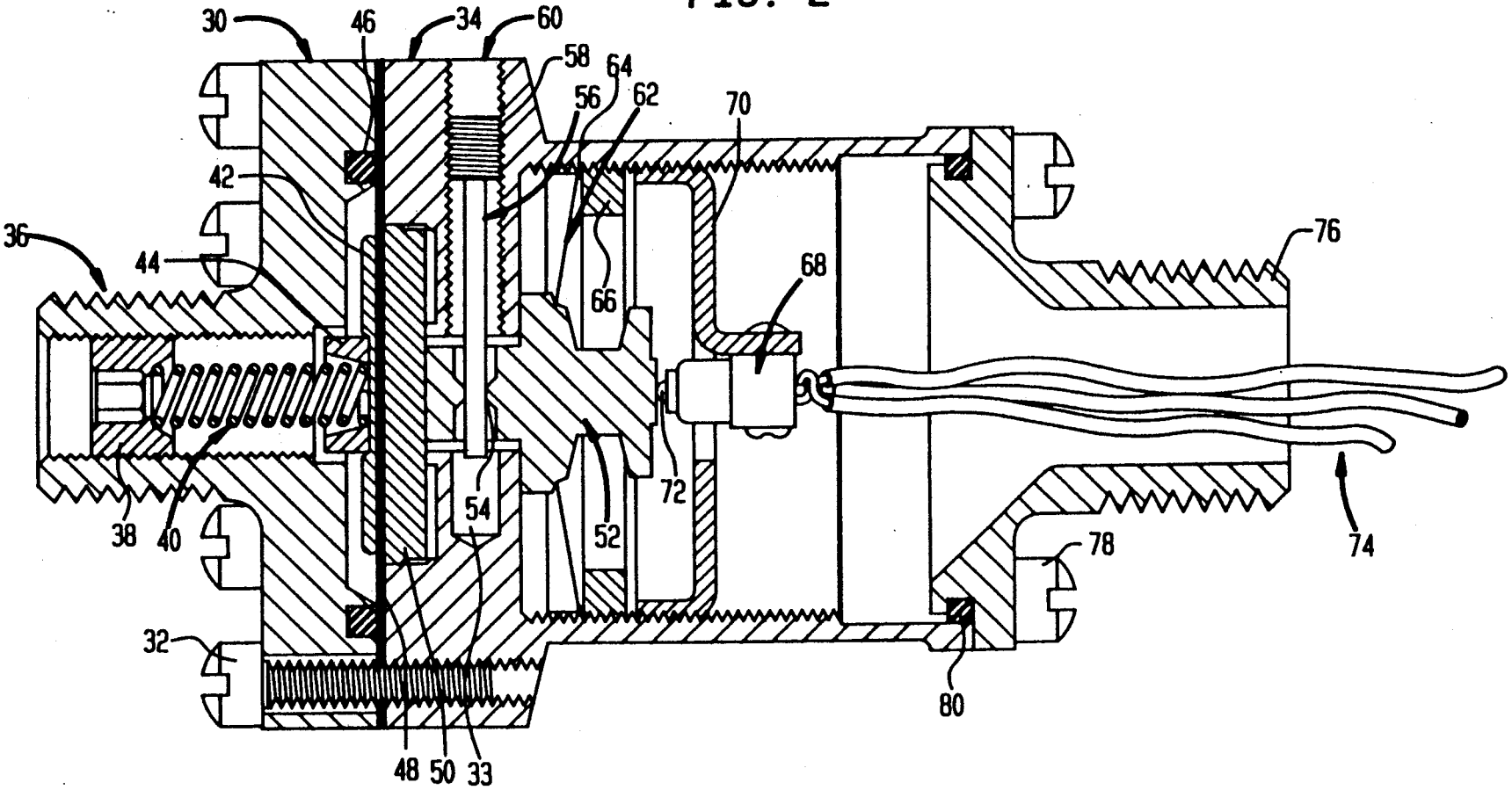
FIG. 2 shows a pressure switch incorporating the wire wand deadband adjustment according to the invention.

The invention may be effectively used in the pressure switch shown in FIG. 2 for adjusting the deadband of the switch. A pressure port 30 is connected by screws 32 to the pressure switch body 34. The port 30 has a threaded pressure connection portion 36. Internally threaded in the portion 36 is a pressure setting adjustment nut 38 with a hole therethrough. A positive rate coil spring 40 is positioned between nut 38 and back up plate 42. A sleeve 44 located within a groove of back up plate 42 positionally retains the spring 40 opposite the nut 38.

An O-ring 46 and a pressure sensor diaphragm 48, which may be a polyimide film, is positioned between body 34 and pressure port 30. A pressure plate 50 which may be fabricated of aluminum is centrally located in body 34 behind diaphragm 48. An actuator 52 has a hole 54 transverse to the operating axis of the pressure switch. Body 34 also has a transverse channel 33 to permit insertion of wire wand 56 having an adjusting nut 58 for adjusting the wand in to and out from the operating axis of the switch through access 60.

Actuator 52 is biased by a negative rate belleville spring 62 which also bears against a rigid ring 64 and retained in position by belleville retainer 66 which is threaded into the interior of body 34. An electrical microswitch 68 is mounted by microswitch holder 70 which is also threaded into the interior of body 34. The contact 72 of microswitch 68 is activated by actuator 52. Electrical leads 74 pass through electrical end port 76 which is attached to body 34 by means of screws 78. An O-ring 80 is positioned between end port 76 and body 34.

The pressure setting adjustment is accomplished by nut 58 after positioning actuator 52 and microswitch 68. The final deadband adjustment is made by movement of wire wand 58 further into or out of the hole in actuator 52 by means of nut 58. One end of wire wand 56 is fixed at nut 58 and the other end is driven by means of the pressure sensor diaphragm 48, pressure plate 50 responsive to diaphragm 48 and actuator 52 responsive to pressure plate 50.

By movement of wand 58, the effective length as described in connection with FIG. 1 is adjusted to control the deadband. The deadband of a pressure switch is a direct function of the algebraic sum of all spring rates, including the wire wand spring rate. Hence adjustment of the wire wand varies its spring rate and provides deadband adjustment.

The invention has application in pressure, temperature, or flow switches, as well as any positive or negative spring rate device where the operating characteristics require adjustability as a function of spring rate.

While the present invention has been disclosed in connection with preferred embodiments thereof, it should be understood that there may be other embodiments which fall within the spirit and scope of the invention as defined by the following claims.

What is claimed is:

1. In combination:

sensor means mounted for movement on an operating axis of a housing; and a wand inserted into said sensor means perpendicular to said operating axis, said wand being fixed and adjustable in said housing at one end and driven at the other end by said sensor means, whereby said wand provides adjustment for said sensor means.

2. The combination of claim 1 wherein said wand is a wire wand with a set screw fixed at one end.

3. The combination of claim 1 wherein said sensor means includes a pressure responsive means and an actuator means, said actuator means having a hole for insertion of said wand therein.

4. The combination of claim 3 including a belleville spring for biasing said actuator in the operating axis.

5. The combination of claim 4 wherein movement by said wand further into and out of said hole in said actuator causes deadband adjustment of said sensor means.

6. A switch comprising:

housing means;

sensor means mounted for movement along an axis of said housing means;

spring means resisting the movement of said sensor means;

wand means mounted in said housing means for insertion into said sensor means in a direction perpendicular to said axis, said wand means providing deadband adjustment of said switch.

7. The switch of claim 6 wherein said sensor means includes an actuator having a hole for insertion of said wand.

8. The switch of claim 6 wherein said sensor means includes a diaphragm and pressure plate.

9. The switch of claim 6 wherein said housing means includes a pressure port.

10. The switch of claim 6 further including an electrical switch responsive to said sensor means.

11. The switch of claim 6 wherein said spring means includes a negative rate belleville spring.

12. The switch of claim 6 wherein said spring means includes a positive rate coil spring.

13. A pressure switch comprising:

a housing;

sensor means mounted for movement along an axis of said housing;

spring means resisting the movement of said sensor means;

wand means fixedly mounted at one end in said housing for insertion into said sensor means in a direction perpendicular to said axis, said wand means being driven at the other end by said sensor means and providing deadband adjustment of said pressure switch.

14. The switch of claim 13 wherein said sensor means includes a spring biased actuator having a hole for insertion of said wand.

15. The switch of claim 14 wherein said sensor means includes a diaphragm and pressure plate.

16. The switch of claim 15 further including an electrical switch responsive to said actuator.

17. The switch of claim 16 wherein said spring means includes a negative rate belleville spring for biasing said actuator.

18. The switch of claim 17 wherein said spring means includes a positive rate coil spring.

19. The switch of claim 13 wherein said wand is a wire wand with a set screw at said one end.

20. The switch of claim 19 including pressure setting adjustment means.

* * * * *